US008002115B2

(12) United States Patent
Rappaport et al.

(10) Patent No.: US 8,002,115 B2
(45) Date of Patent: Aug. 23, 2011

(54) CONTAINERS AND OTHER OBJECTS WITH INTEGRATED DISPENSER

(76) Inventors: Karen Rappaport, Surfside, FL (US); Denise Goldman, Miami Beach, FL (US)

( * ) Notice: Subject to any disclaimer, the term of this patent is extended or adjusted under 35 U.S.C. 154(b) by 474 days.

(21) Appl. No.: 11/899,789

(22) Filed: Sep. 7, 2007

(65) Prior Publication Data

US 2008/0060972 A1 Mar. 13, 2008

Related U.S. Application Data

(60) Provisional application No. 60/842,903, filed on Sep. 7, 2006.

(51) Int. Cl.
*A45C 15/00* (2006.01)
*B65D 83/00* (2006.01)

(52) U.S. Cl. ..... 206/581; 206/233; 150/112

(58) Field of Classification Search ..... 206/581, 206/494, 233, 812, 823, 818, 223; 150/106, 150/108, 112; 383/40
See application file for complete search history.

(56) References Cited

U.S. PATENT DOCUMENTS

| | | | | | |
|---|---|---|---|---|---|
| D250,793 | S | * | 1/1979 | Siegel | D3/243 |
| D250,794 | S | | 1/1979 | Siegel | |
| 4,236,559 | A | * | 12/1980 | Archbold | 224/610 |
| D260,198 | S | | 8/1981 | Siegel | |
| D263,649 | S | | 4/1982 | Schimmel | |
| 4,735,317 | A | * | 4/1988 | Sussman et al. | 206/449 |
| 4,739,809 | A | * | 4/1988 | Adams | 150/112 |
| 5,207,254 | A | * | 5/1993 | Fromm | 150/104 |
| 5,447,227 | A | * | 9/1995 | Kosberg | 206/233 |
| 5,702,038 | A | * | 12/1997 | Miller et al. | 224/409 |
| 5,713,616 | A | * | 2/1998 | Knudson | 294/1.3 |
| 5,749,447 | A | * | 5/1998 | Hersh et al. | 190/112 |
| 6,439,386 | B1 | * | 8/2002 | Sauer et al. | 206/494 |
| 6,491,074 | B1 | * | 12/2002 | Roegner | 150/112 |
| 2005/0263556 | A1 | * | 12/2005 | Labit et al. | 224/610 |
| 2006/0283750 | A1 | * | 12/2006 | Villars et al. | 206/494 |
| 2007/0062994 | A1 | | 3/2007 | Shoemaker et al. | |

OTHER PUBLICATIONS

Related co-pending U.S. Appl. No. 29/291,663, filed Sep. 7, 2007, Inventors: Karen Rappaport et al, Title: Diaper Bag With Integrated Wipes Dispenser.

* cited by examiner

*Primary Examiner* — Steven A. Reynolds
(74) *Attorney, Agent, or Firm* — Holtz, Holtz, Goodman & Chick, PC

(57) ABSTRACT

Container including front, rear and intermediate panels forming a main internal compartment therebetween in which items can be stored, a flap portion of the rear panel being movable to enable access to the main compartment and expose a portion of the front panel which includes an opening. The front panel and internal panel define a side compartment communicating with the opening. A cover is arranged over the opening and includes a slit. When the dispensable items are retained in the side compartment, they can be removed from the side compartment through the slit when the flap portion is moved to expose the opening in the front panel. The container may be used as a diaper bag in which diapers are placed into the main compartment and diaper wipes into the side compartment whereby the diaper wipes are sealed in the side compartment and do not dry out.

19 Claims, 7 Drawing Sheets

CONTAINERS AND OTHER OBJECTS WITH INTEGRATED DISPENSER

CROSS-REFERENCE TO RELATED APPLICATION

This application claims the benefit of the filing date of U.S. provisional patent application Ser. No. 60/842,903 filed Sep. 7, 2006, incorporated by reference herein.

FIELD OF THE INVENTION

The present invention relates in general to containers and other objects having an integral or integrated compartment into which wipes or similar objects can be placed, and dispensed therefrom when needed.

More particularly, the present invention relates to a container having an integral or integrated diaper wipe dispenser and even more particularly to a diaper bag capable of carrying diapers and a stack of folded diaper wipes and which provides moisture-retention for the diaper wipes and also enables easy dispensing of the diaper wipes.

The present invention also relates to changing pads on which babies and infants are placed during a diaper change which include an integral or integrated diaper wipe dispenser.

The present invention also relates to other objects for potential use in connection with babies or infants which might be needed when changing a diaper, and which include an integral or integrated compartment into which diaper wipes or similar items may be placed and dispensed when needed.

BACKGROUND OF THE INVENTION

When traveling with a baby or small infant wearing diapers, an individual typically has available a diaper and wipes so that in the event the baby or infant soils the diaper they are currently wearing, they can be changed. To this end, there are numerous diaper bags on the market which have an interior compartment capable of receiving one or more diapers and a disposable, self-contained package of diaper wipes.

There are generally three main types of diaper wipe packages. One type has a hard plastic outer casing with a pivotable lid which opens to expose a stack of diaper wipes therein. A second type also has a hard, plastic outer casing but includes a dispenser member over the stack of diaper wipes and a lid which pivots to cover or expose a slit in the dispenser member through which the diaper wipes are individually dispensed. This type is commonly referred to as a pop-up type diaper wipe dispenser. The first and second types can be repeatedly refilled with a new stack of diaper wipes. The third type is a single-use, disposable, flexible plastic package including a stack of diaper wipes and a slit in a broad surface of the package to enable the individual to grasp a diaper wipe and pull it through the slit. A disadvantage of the first two types of package is that they are clunky and take up a lot of space in smaller diaper bags. A disadvantage of the third type of package is that there is a premium for the disposable nature of the package (thus making it less economical) and it is not securely retained in the diaper bag and can move around, possibly being buried underneath other objects in the diaper bag. Another problem with some types of the disposable packages, is that a diaper wipe may be partially pulled through the slit. As such, the portion pulled through the slit is exposed in the diaper bag and can accumulate dirt which would render it unsanitary and inadvisable for use when wiping the baby or infant. Moreover, the portion pulled through the slit may dry out which further renders it ineffective for use.

Another disadvantage of all of these prior art diaper wipe packages is that when carried in a larger diaper bag or other container, it is necessary to first locate the diaper wipe package, and other accessories for performing the diaper change, inside of the larger diaper bag. This process may be time-consuming and require hands-on attention by the individual while they are attending to the baby or infant in need of a diaper change. Thus, the individual must not only keep a hand on the baby or infant, they must also search around the larger diaper bag for a diaper and a diaper wipe package. Obviously, the more attention the individual must give to locating the diaper and diaper wipes translates into less attention on the baby or infant, which is very disadvantageous.

It would therefore be desirable to provide a container having a defined compartment capable of receiving a stack of diaper wipes with the diaper wipes being secured in the compartment in a moisture-retaining manner.

OBJECTS AND SUMMARY OF THE INVENTION

It is an object of the present invention to provide new containers and other objects with integrated or integral dispensers.

It is another object of the present invention to provide new and improved containers and other objects capable of receiving both diapers and diaper wipes and enabling dispensing of the diaper wipes.

It is yet another object of the present invention to provide new containers having a defined compartment capable of receiving a stack of diaper wipes with the diaper wipes being secured in the compartment and easily dispensed therefrom.

Accordingly, to achieve at least one of these objects and possibly others, one embodiment of a container in accordance with the invention having an integral, selectively accessible compartment, which functions as an integral diaper wipe dispenser when containing diaper wipes, includes a plurality of panels forming a main internal compartment therebetween, a first one of the panels being movable to enable access to the main compartment and expose at least a portion of that panel or a second one of the panels which includes an opening. A side compartment communicating with the opening is formed by one or more of the panels, and is designed to retain a stack of diaper wipes. A cover is arranged over the opening and includes a slit. Having this construction, when diaper wipes are retained in the side compartment, the diaper wipes can be removed from the side compartment through the slit when the first panel is moved to expose the portion of that panel or of the second panel including the opening.

More specifically, in one embodiment, the first panel may be a rear panel having a flap portion and the second panel may be a front panel. The flap portion is movable between a position overlying at least a part of the front panel, which includes the opening, and a position in which a top of the main compartment is open to thereby enable access to, for example, diapers stored in this main compartment. An intermediate panel extends between the front and rear panels on a bottom and sides of the main compartment, although multiple intermediate panels may be provided.

An attachment mechanism is provided to enable attachment of the flap portion of the rear panel to the front panel, as well as separation of the flap portion from the front panel to enable access to the main compartment and the slit to enable dispensing of diaper wipes from the side compartment.

Optionally, a window is arranged on an inner surface of the flap portion. The window may be rectangular and attached to the inner surface of the flap portion on only three sides so that a slot is formed between the window and the flap portion into which an identification card can be inserted. in a position in which it overlies the slit when the flap portion of the rear panel covers the part of the front panel The side compartment may be defined between the front panel and a third, internal panel between the front and rear panels. A zipper may be arranged between upper edge portions of the front and internal panels. Preferably, the portions of the front and internal panels defining the side compartment are made of or coated with a moisture-repellent material so that when diaper wipes are placed in the side compartment, they do not dry out.

To partition the main compartment or form another side compartment, a mesh member may be attached along its sides and bottom to an inner surface of the rear panel. In addition, another side compartment accessible even when the flap portion overlies the front panel may be formed by attaching a panel to the inner surface of the rear panel on both sides of a slit in the rear panel and arranging a zipper in the slit.

It must be understood that the intended use of the compartment for storing diaper wipes does not limit the applications of the invention. Rather, the compartment in the container described above can be used to retain any type of dispensable material, including but not limited to tissues, towels, towelettes and the like. Moreover, although the main compartment of the container would optimally be used to store diapers when the compartment is used to retain diaper wipes, the main compartment could be used to store any and all objects which can fit therein, whether related to a diaper change or not. Thus, it is envisioned that the main compartment and side compartment can be used as desired by the user, while providing the user with the ability to dispense objects from the side compartment.

Other and further objects, advantages and features of the present invention will be understood by reference to the following specification in conjunction with the annexed drawings, wherein like parts have been given like numbers.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figures 1, 2:
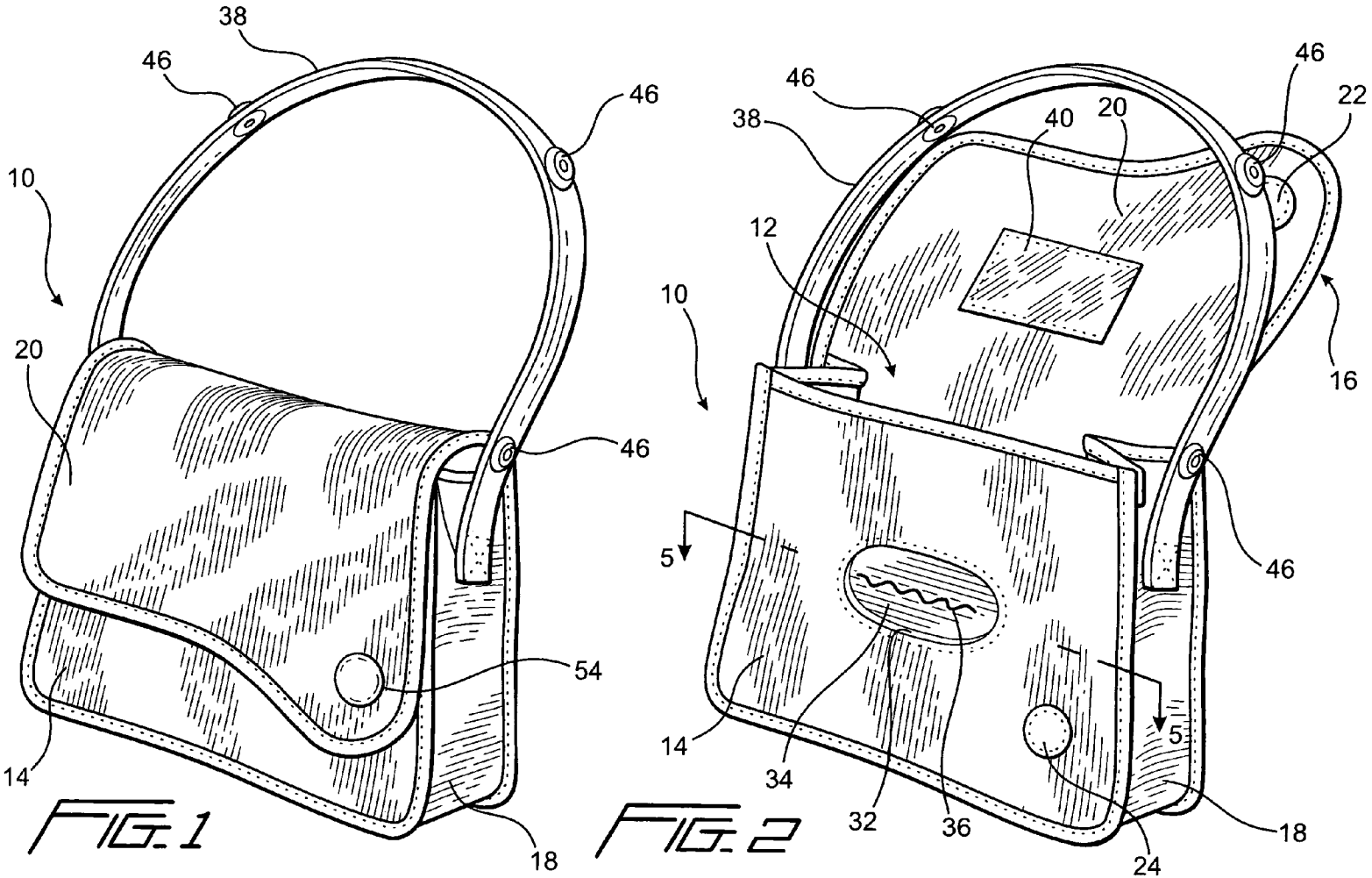
FIG. 1 is a front, right side perspective view of a first embodiment of a container in accordance with the invention.
FIG. 2 is a front, right side perspective view of the container shown in FIG. 1 in an open position.

Referring to the accompanying drawings wherein like reference numerals refer to the same or similar elements, a container in accordance with the invention is designated generally as 10 and includes several panels which form a main, interior compartment 12 therebetween. Container 10 includes a front panel 14, a rear panel 16 and an intermediate panel 18 which extends between the front and rear panels 14, 16 on a bottom and right and left sides of the compartment 12. Rear panel 16 includes a flap portion 20 which folds over onto the front panel 14 and thereby closes a top of the compartment 12. Although intermediate panel 18 is shown connecting the front and rear panels 14, 16 on the bottom and left and right sides (and thus having a U-shaped form), multiple intermediate panels may be provided, for example, one on each of the bottom and left and right sides.

An attachment mechanism 22, 24 is arranged on an inner surface of the rear panel 16 and on the outer surface of the front panel 14, respectively, to enable the flap portion 20 to be secured to the front panel 14. Attachment mechanism 22, 24 may be two parts of a snap, complementary Velcro® fasteners and the like. If so desired, multiple attachment mechanisms may be provided, for example, a snap on each side of the flap portion 20. Alternatively, no attachment mechanism may be provided.

Figure 4:
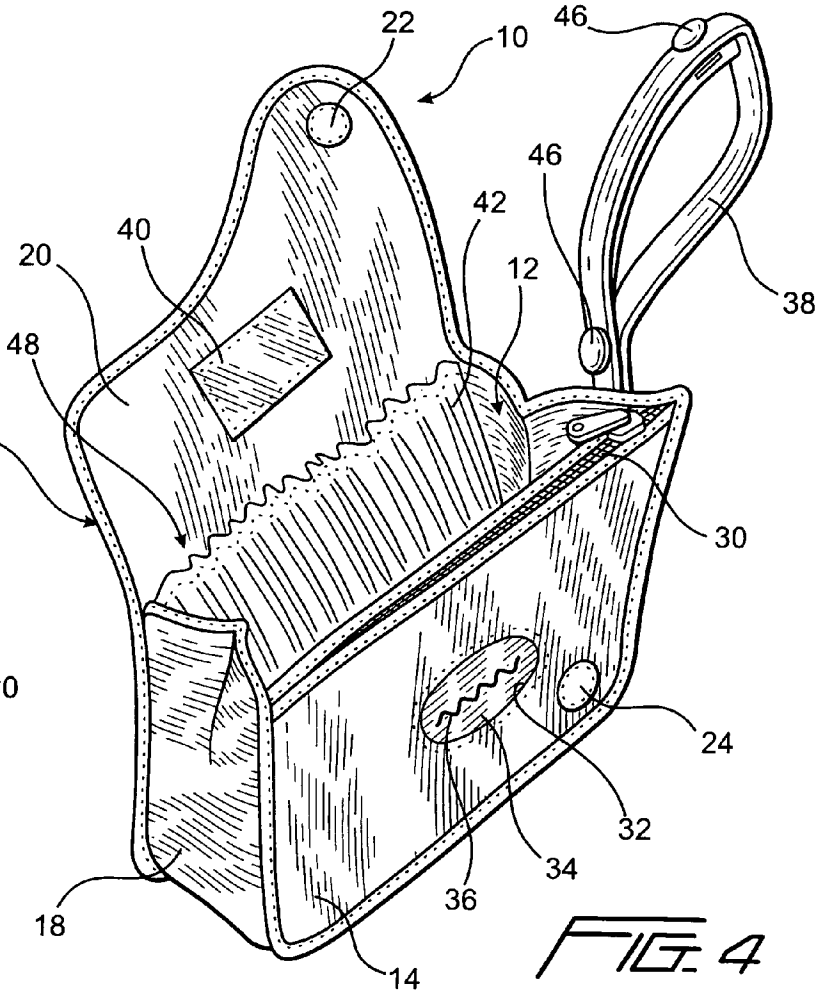
FIG. 4 is a front, left side perspective view of the container shown in FIG. 1 in an open position.
Figure 5:
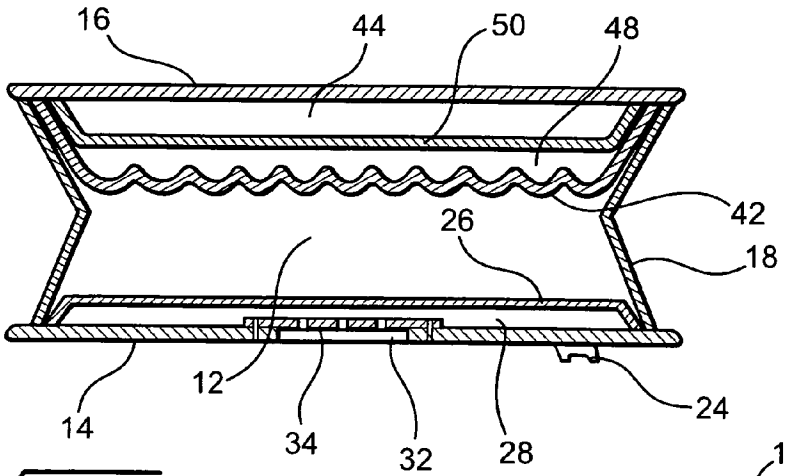
FIG. 5 is a cross-sectional view taken along the line 5-5 of FIG. 2.

An internal panel 26 is arranged to face the inner surface of the front panel 14 and defines a compartment 28 therebetween (see FIG. 5). A zipper 30 is arranged between an upper edge portion of the internal panel 26 and the front panel 14, with the internal panel 26 preferably being attached at locations apart from the zipper 30 to the front panel 14 or to the intermediate panel 18 (see FIG. 4). Zipper 30 thereby selectively allows access to the compartment 28. Instead of a zipper 30, other mechanisms for selectively enabling access to a compartment can be used, for example, complementary Velcro® fasteners.

Front panel 14 includes an opening 32 and a sheet 34 covers the opening 32 (see FIGS. 2, 4 and 5). Sheet 34 is preferably made of a flexible plastic material and includes a slit 36 (see FIGS. 2 and 4). Slit 36 may have an undulating form as shown or be straight or curved in a different manner. Sheet 34 is attached to the front panel 14, either to the inner surface thereof (as shown), to the outer surface thereof or to the periphery of the opening 32, by any known material attachment technique. In the illustrated embodiment, the sheet 34 is attached to the inner surface of the front panel 14 by stitching. Sheet 34 has a size at least slightly larger than the opening 32 and may extend uniformly (e.g., an oval sheet with an oval opening) or non-uniformly (e.g., a rectangular sheet with an oval opening) around the perimeter of the opening 32. Sheet 34 may extend over only a portion of the front panel 14. Opening 32 and slit 36 in sheet 34 are positioned to enable easy dispensing of diaper wipes when a stack of such diaper wipes are retained in the compartment 28. To this end, the opening 32 may be approximately centered lengthwise and widthwise relative to the compartment 28 and the slit 36 positioned in the middle of the opening 32. As such, an approximate central region of an outermost diaper wipes in the stack of diaper wipes in the compartment 28 would be grasped through the slit 36 by the individual.

By forming compartment 28 between the front and rear panels 14, 16 and providing rear panel 16 with the ability to cover the slit 36, diaper-wipe containing compartment 28 is therefore an internal compartment which is not accessible when the container 10 is in its closed position (with flap portion of the rear panel 16 overlying the front panel 14 as shown in FIG. 1). Diaper wipes in the compartment 28 are therefore securely retained and cannot be inadvertently removed without first opening the container 10.

Additional features of the container 10 include a strap 38 attached at each end to the intermediate panel 18, a window 40 arranged on the inner surface of the flap portion 20 of the rear panel 16, a mesh member 42 opposite the inner surface of the rear panel 16, and an outside pocket 44 accessible through the rear panel 16.

Figure 3:
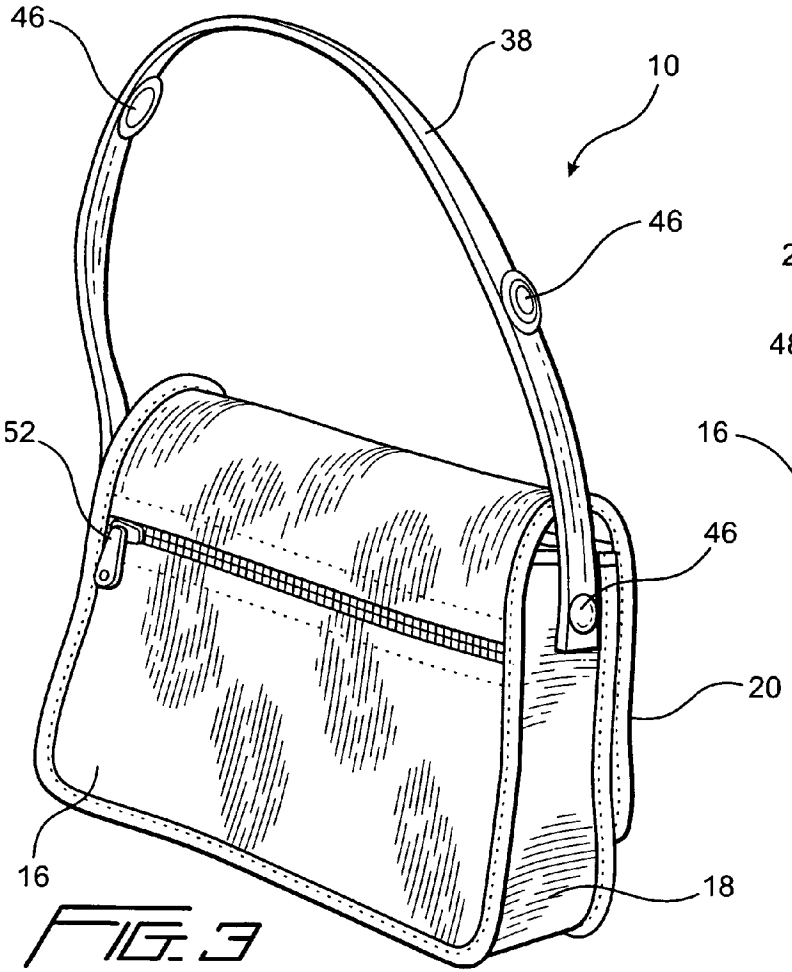
FIG. 3 is a rear, left side perspective view of the container shown in FIG. 1

Strap 38 includes a plurality of snaps 46 which enable the strap 38 to assume different configurations. In the configuration illustrated in FIGS. 1-3, the strap 38 can be used like a purse whereas in a configuration illustrated in FIG. 4, the strap 38 can be used like a wristlet. Different configurations of straps are envisioned for use in the invention, including one which can be connected at multiple locations to each side of the intermediate panel 18.

In one embodiment, as shown in FIGS. 2 and 4, window 40 may be arranged in a position in which it will overlie the sheet 34, or at least the slit 36 in the sheet 34, when the flap portion 20 of the rear panel 16 is folded over onto the front panel 14. This will serve to close the slit 36 and, when window 40 is made of a moisture-resistant or moisture-retardant material, inhibits or prevents evaporation of moisture from moistened items in the compartment 28, e.g., prevents evaporation of moisture from diaper wipes or moistened towelettes when placed in the side compartment 28. Closure of the slit 36 would also be effective to prevent evaporation of other liquids from the items in the side compartment 28, e.g., lotion from a tissue or towelettes containing the same.

Alignment of the window 40 with the sheet 34 or slit 36 is not required. In this case, since the flap portion 20 will otherwise overlie the sheet 34 and slit 36, it will substantially prevent evaporation moisture from the diaper wipes in compartment 28. More generally, the container 10 is designed so that one portion thereof will overlie the slit 36 and create a tight closure over the slit 36.

Mesh member 42 is preferably attached along its sides and bottom to the rear panel 16 or the intermediate panel 18 to define a visible compartment 48 alongside the rear panel 16. Objects such as diaper creams and hand sanitizers can be securely placed into this compartment 48.

Outside pocket 44 is formed by a panel 50 attached at opposite ends to the inner surface of the rear panel 16 on opposite sides of a slit in the rear panel 16, and also possibly to the intermediate panel 18 (see FIG. 5). A zipper 52 is attached to the rear panel 16, i.e., arranged in the slit, to enable access to the pocket 44 (see FIG. 3). Panel 50 may be attached to the inner surface of the rear panel 16 by stitching shown in FIG. 3.

In one exemplifying embodiment, the panels 14, 16, 18, 26 and 50 are made from 600 dernier polyester duck with 100% nylon pack cloth lining. The surfaces of the internal panel 26 and front panel 14 defining the diaper-wipe receiving compartment 28 are preferably lined with or made from a moisture-lock material which prevents evaporation of the moisture from the diaper wipes when received in the compartment 28, one exemplifying material being PVC. Thus, the internal panel 26 may be made entirely from a moisture-lock material. Exterior surfaces of the container 10 are preferably made of or coated with a water-repellent/stain-resistant material. A waterproof lining for the exposed surfaces of the container 10 is also preferred. Sheet 34 is preferably made from a flexible, soft touch thermoplastic.

A logo 54 may be attached to the outer surface of the flap portion 20 of the rear panel as shown in FIG. 1.

Panels 14, 16, 18 are shown connected by or lined with a trim. Such a trim is not required for a container in accordance with the invention. When present, the trim may have various styles and be made of different materials. The color of the trim may be the same as or differ from the color of the panels 14, 16, 18. The trim may also be made of printed cotton.

Although a primary use of the container 10 is for carrying diapers in side compartment 12 and diaper wipes in the main compartment 28, i.e., as a diaper bag, the container 10 can be used to carry other objects and the invention is not limited to any particular use.

If the container 10 is carried and used to aid in a diaper change of a bay or infant, then the compartment 28 would optimally include diaper wipes, e.g., moistened diaper wipes, or other types of moistened tissues or towelettes. The main compartment 12 would thus include at least diaper and possibly other accessories for use in the diaper change, e.g., a lotion or a cream.

However, if the container 10 is carried and used for another purpose, then the contents of compartments 12 and 28 could be selected as desired for whatever purpose the container 10 is being carried and used for. The individual could thus place any items they expect to need in the compartments 12, 28 with side compartment 28 preferably being used to retain a dispensible item, such as tissues or towelettes.

Figure 7:
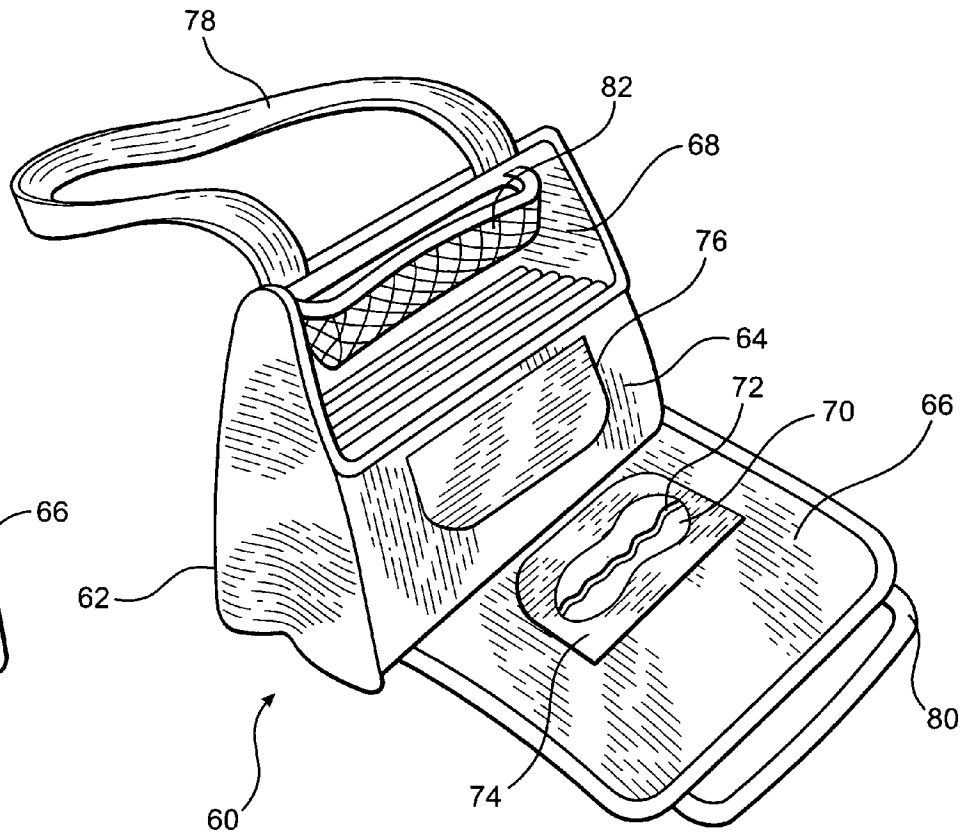
FIG. 7 is a front, left side perspective view of the container shown in FIG. 6 in an open position.
Figure 6:
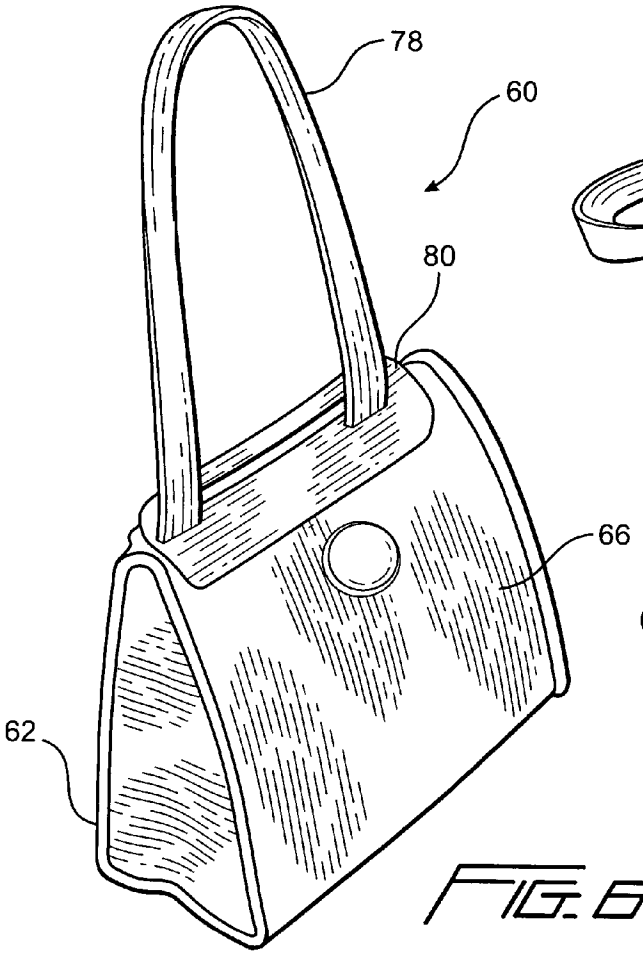
FIG. 6 is a front, left side perspective view of a second embodiment of a container in accordance with the invention.

Referring now to FIGS. 6 and 7, a second embodiment of a container in accordance with the invention is designated generally as 60. Container 60 includes a plurality of panels 62, 64, 66 forming a main interior compartment 68 therebetween, with panel 66 being pivotally connected to panel 64 to enable access to the main compartment 68. Panel 66 includes inner and outer subpanels which define a compartment therebetween having an access opening through which a stack of diaper wipes, or other dispensible items, can be placed into the compartment. This access opening may be formed either on the outer subpanel of panel 66 or on the inner subpanel of panel 66, and a zipper or other comparable mechanism is provided to enable the access opening to be closed or opened at will.

The inner subpanel of panel 66 includes an opening and a sheet 70 covers the opening (see FIG. 7). Sheet 70 includes a slit 72 and is attached to the inner or outer surface of the inner subpanel of panel 66 or to the periphery of the opening by any known material attachment technique. The opening and slit 72 in sheet 70 are positioned to enable easy dispensing of a diaper wipe, or other dispensible item, when a stack of such diaper wipes or dispensible items are retained in the compartment formed in the panel 66 (such as described above).

A magnetic plate 74 is arranged around the sheet 70 and attached to the inner surface of the inner subpanel of panel 66. A second magnetic plate 76 is arranged on panel 64 in a position in which it will contact magnetic plate 74 when container 60 is in the closed position shown in FIG. 6. Contact between the magnetic plates 74, 76 will provide a tight closure over the slit 72 and prevent the moisture in diaper wipes, or other moistened items, in the compartment in panel 66 from evaporating. Such contact will also aid in maintaining panels 64, 66 together and thus container 60 in its closed position.

Additional features of the container 60 include a strap 78 attached at each end to the panel 62, a closure loop 80 attached to the panel 66 and arranged to enable strap 78 to pass therethrough and thereby close the main compartment 68, and a mesh member 82 attached to an inner surface of panel 62 to define a pouch for retaining objects.

Figure 9:
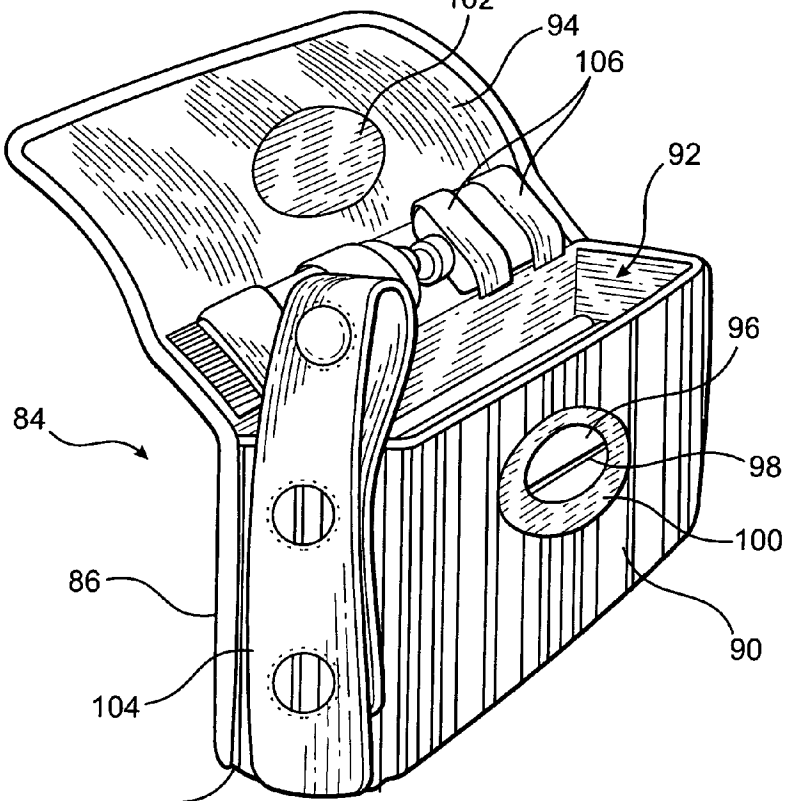
FIG. 9 is a front, left side perspective view of the container shown in FIG. 8 in an open position.
Figure 8:
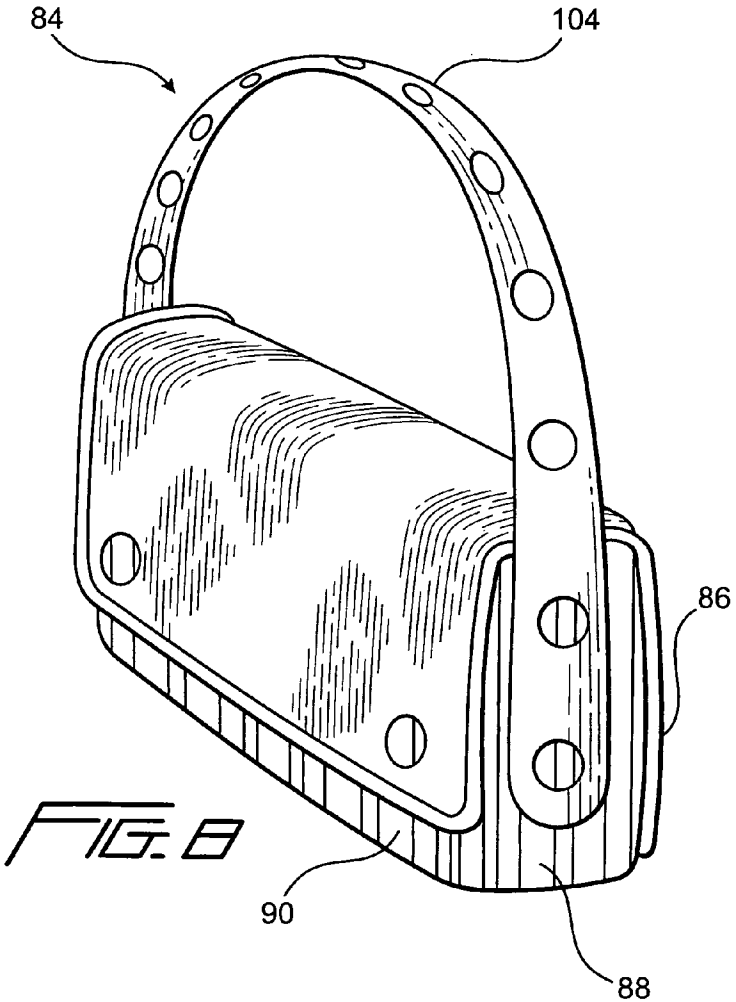
FIG. 8 is a front, right side perspective view of a third embodiment of a container in accordance with the invention.

Referring now to FIGS. 8 and 9, a third embodiment of a container in accordance with the invention is designated generally as 84. Container 84 includes a plurality of panels 86, 88, 90 forming a main interior compartment 92 therebetween, with a flap portion 94 of panel 86 being movable to overlie an outer, front surface of panel 90. Panel 90 includes a compartment having an access opening through which a stack of diaper wipes can be placed into the compartment. Instead of diaper wipes, any other item or items capable of being dispensed can be placed into this compartment, for example, moistened towelettes or tissues. This access opening may be formed on an outer or inner surface of panel 90, and a zipper or other comparable mechanism provided to enable the access opening to be closed or opened at will.

The front surface of panel 90 includes an opening and a sheet 96 covers the opening (see FIG. 9). Sheet 96 includes a slit 98 and is attached to either the inner or outer surface of panel 90 or to the periphery of the opening by any known material attachment technique. The opening and slit 98 in sheet 96 are positioned to enable easy dispensing of diaper wipes, or other dispensible item or items, when a stack of such diaper wipes or items are retained in the compartment formed in the panel 90 (such as described above).

A magnetic plate 100 is arranged around the sheet 96 and attached to the outer surface of the panel 90. A second magnetic plate 102 is arranged on flap portion 94 of panel 86 in a position in which it will contact magnetic plate 100 when flap portion 94 is folded over panel 90 and the container 84 is in the closed position shown in FIG. 8. Contact between the magnetic plates 100, 102 provides a tight closure over the slit 98 and prevents the moisture in diaper wipes in the compartment in panel 90, or moisture or liquid from other moistened or liquid-containing item or items placed therein, from evaporating. Such contact will also aid in provided a secure attachment of panels 86, 90 together and maintain the container 84 in its closed position.

Additional features of the container 84 include a strap 104 attachable at each end to the panel 88 (FIG. 8) or attachable to only one side of the panel 88 (FIG. 9) and bands 106 attached to the inner surface of panel 86 to enable small tubes or bottles to be secured to the panel 86. Such bands can be used in any of the other embodiments herein.

Figure 10:
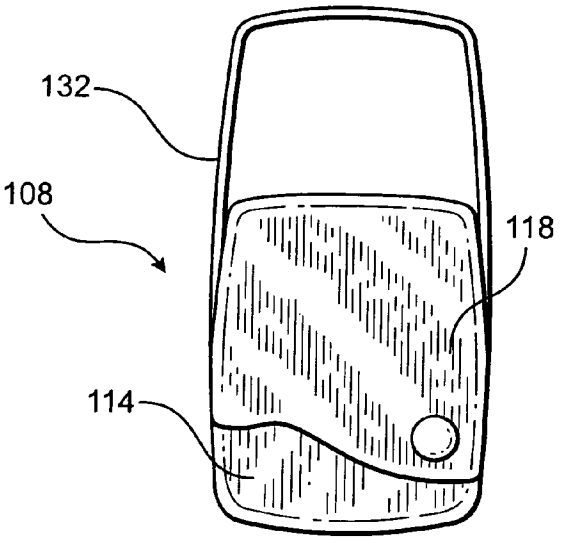
FIG. 10 is a front view of a fourth embodiment of a container in accordance with the invention.
Figure 11:
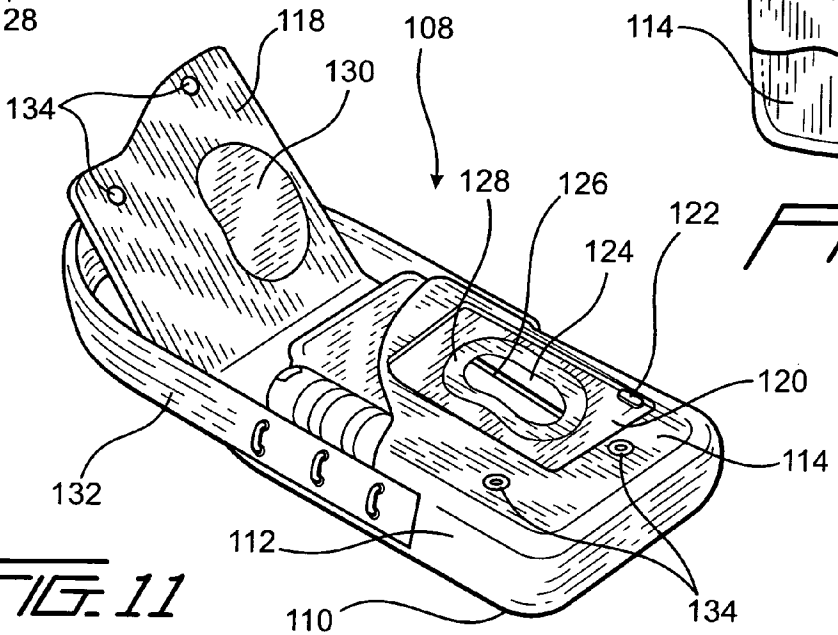
FIG. 11 is a front, left side perspective view of the container shown in FIG. 10 in an open position.

Referring now to FIGS. 10 and 11, a fourth embodiment of a container in accordance with the invention is designated generally as 108. Container 108 includes a plurality of panels 110, 112, 114 forming a main interior compartment 116 therebetween, with a flap portion 118 of panel 110 being movable to overlie an outer, front surface of panel 114. A side panel 120 is attached to panel 114 to define a side compartment therebetween having an access opening through which a stack of diaper wipes can be placed into the compartment. A zipper 122 is provided to enable the access opening to be closed or opened at will.

The front surface of side panel 120 includes an opening and a sheet 124 covers the opening (see FIG. 11). Sheet 124 includes a slit 126 and is attached to either the inner or outer surface of panel 120 or to the periphery of the opening by any known material attachment technique. The opening and slit 126 in sheet 124 are positioned to enable easy dispensing of diaper wipes when a stack of such diaper wipes are retained in the compartment formed between the panels 114, 120. Instead of diaper wipes, other dispensible items can be arranged in the compartment formed between the panels 114, 120.

A magnetic plate 128 is arranged around the sheet 124 and attached to the outer surface of the side panel 120. A second magnetic plate 130 is arranged on flap portion 118 of panel 110 in a position in which it will contact magnetic plate 128 when flap portion 118 is folded over panel 120 and the container 108 is in the closed position shown in FIG. 10. Contact between the magnetic plates 128, 130 provides a tight closure over the slit 126 and prevents the moisture in diaper wipes in the compartment between panels 114, 120 from evaporating, or prevents the moisture or other liquid in moisture or liquid-containing items placed in the compartment between panels 114, 120 from evaporating. Such contact will also aid in maintaining panels 114, 120 together and thus the container 108 in its closed position.

Additional features of the container 108 include a strap 132 attachable at each end to the panel 112 and attachment mechanisms 134 attached to the inner surface of flap portion 118 and the outer surface of panel 114 to provide for engagement of the panels 110, 114 together. Panels 110, 112, 114 may be made of a rigid or semi-rigid material, with panel 110 being provided with weakened sections to enable the formation of flap portion 118.

Figure 12:
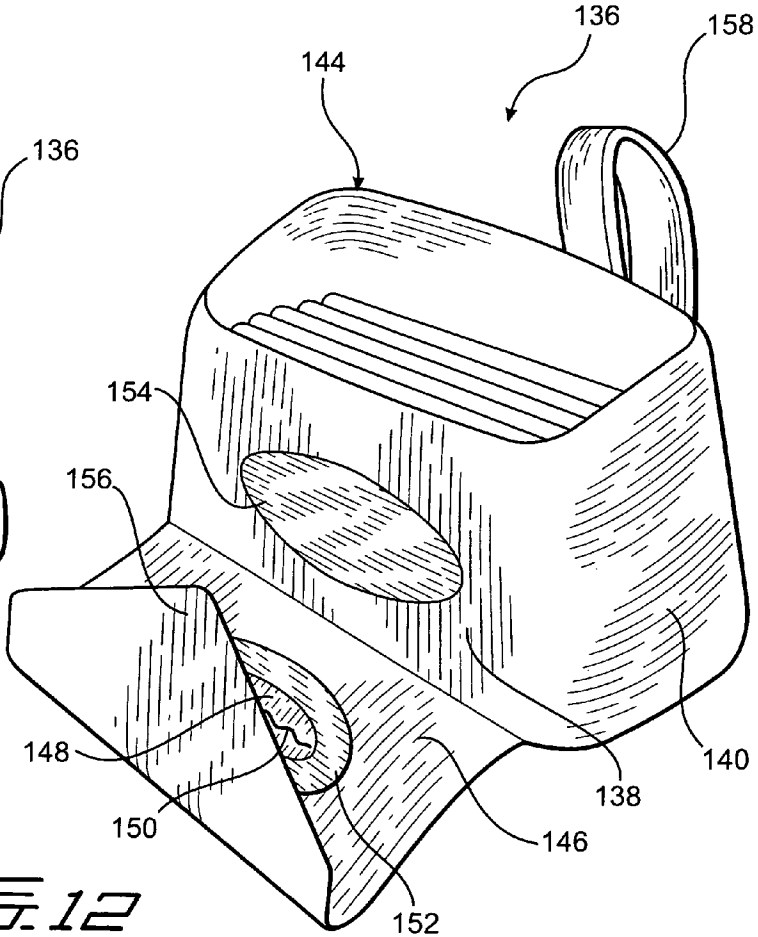
FIG. 12 is a front, right side perspective view of a fifth embodiment of a container in accordance with the invention in an open position.
Figure 13:
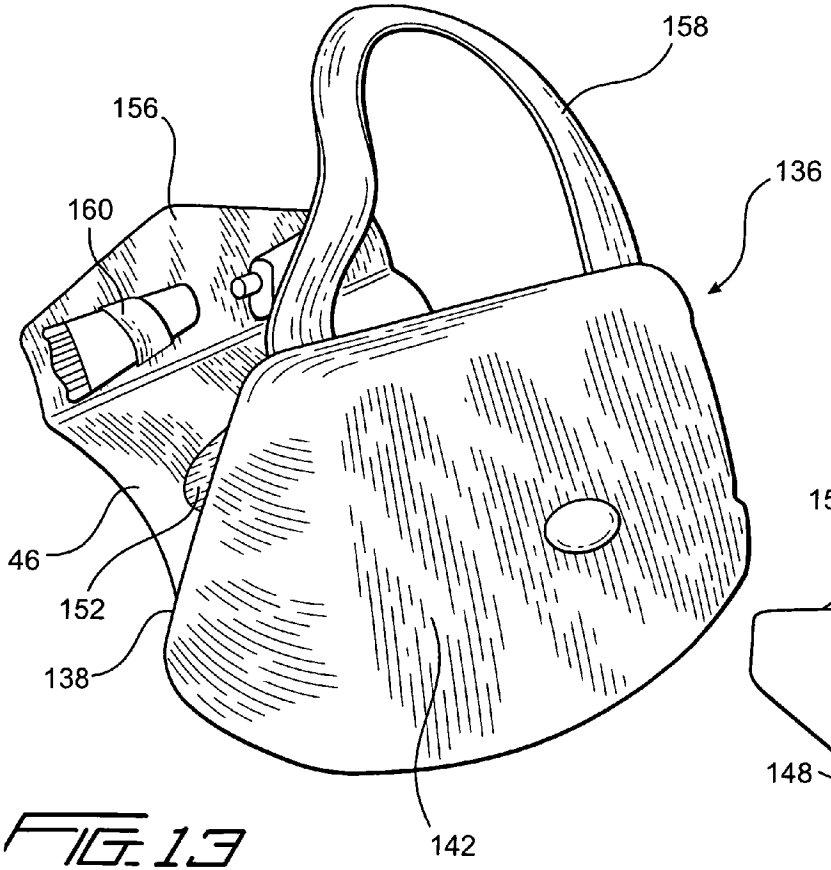
FIG. 13 is a rear, right side perspective view of the container shown in FIG. 12 in an open position.

Referring now to FIGS. 12 and 13, a fifth embodiment of a container in accordance with the invention is designated generally as 136. Container 136 includes a plurality of panels 138, 140, 142, forming a main interior compartment 144 therebetween, and a flap panel 146 being pivotally connected to panel 138 and movable to overlie a top of the main compartment 144. Flap panel 146 includes a compartment having an access opening through which a stack of diaper wipes, or other dispensible items, can be placed into the compartment. This access opening may be formed either on an outer or inner surface of flap panel 146, and a zipper or other comparable mechanism provided to enable the access opening to be closed or opened at will.

The rear surface of flap panel 146 includes an opening and a sheet 148 covers the opening (see FIG. 12). Sheet 148 includes a slit 150 and is attached to the inner or outer surface of flap panel 146 or to the periphery of the opening by any known material attachment technique. The opening and slit 150 in sheet 148 are positioned to enable easy dispensing of diaper wipes, or other dispensible items, when a stack of such diaper wipes or dispensible items are retained in the compartment formed in the flap panel 146.

A magnetic plate 152 is arranged around the sheet 148 and attached to the inner surface of the flap panel 146. A second magnetic plate 154 is arranged on panel 138 in a position in which it will contact magnetic plate 152 when container 136 is in the closed position. Contact between the magnetic plates 152, 154 provides a tight closure over the slit 148 and prevents the moisture in diaper wipes in the compartment in flap panel 146 from evaporating, or prevents the moisture or other liquid in moisture or liquid-containing items placed in the compartment in flap panel 146 from evaporating. Such contact will also aid in maintaining panels 138, 144 together and thus container 136 in its closed position. In the closed position of container 136, an overhang portion 156 of flap panel 146 engages with the panel 142 so that the flap panel 146 covers the top of the compartment 144.

Additional features of the container 136 include a strap 158 attached at each end to the panel 140 and bands 160 attached to the inner surface of flap panel 146 to enable small tubes or bottles to be secured to the flap panel 146.

Figure 16:
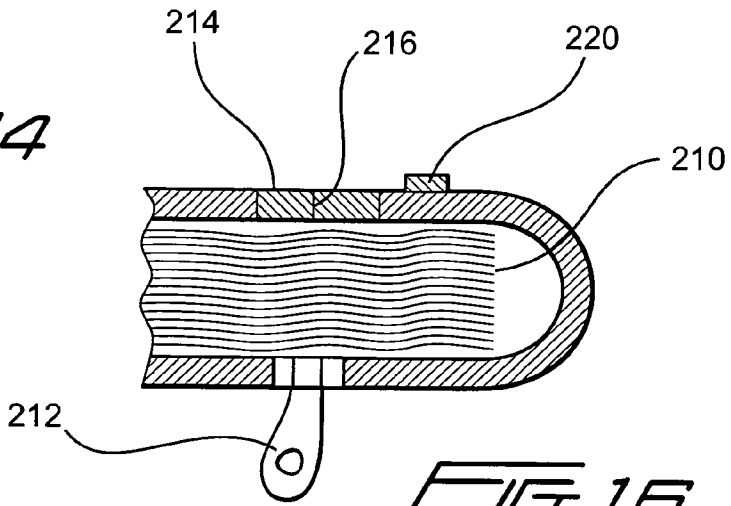
FIG. 16 is a cross-sectional view taken along the line 16-16 of FIG. 15.
Figure 14:
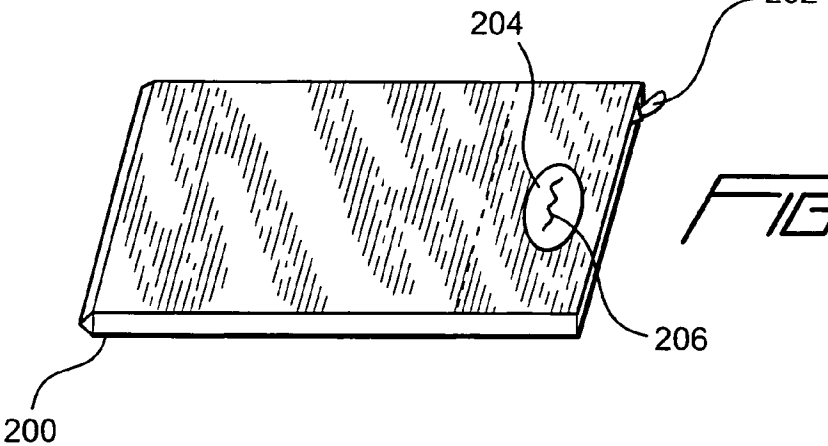
FIG. 14 is a perspective view of a first embodiment of a changing pad with an integral diaper wipe dispenser in accordance with the invention.
Figure 15:
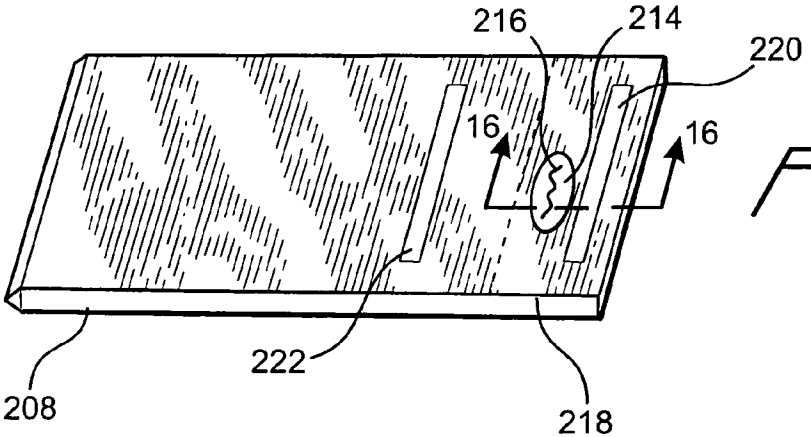
FIG. 15 is a perspective view of a second embodiment of a changing pad with an integral diaper wipe dispenser in accordance with the invention.

Referring now to FIGS. 14-16, a changing pad can also be provided with an integral or integrated diaper wipe dispenser. As shown in FIG. 14, a first embodiment of a changing pad is designated generally as 200 and includes a substantially planar substrate, formed form one or more panels or layers as conventional changing pads, but also includes an internal compartment in which diaper wipes can be placed, which compartment is accessible by means of a zipper 202 arranged at one end of the changing pad 200. The compartment may ideally be dimensioned to accommodate a stack of diaper wipes with only marginal room around them. Instead of a zipper 202, other apparatus for enabling access to the compartment to enable insertion of diaper wipes may be provided.

The upper surface of the changing pad 200, which may be formed by a panel or sheet, is provided with an opening communicating with the diaper-wipe receiving compartment and a sheet 204 having a slit 206 is attached to this panel or sheet of the changing pad 200 to cover the opening. Changing pad 200 can be folded or rolled in the conventional manner or otherwise manipulated into a compact configuration with the slit 206 being covered by another portion of the changing pad 200 to prevent moisture from evaporating from the diaper wipes, when the material of the changing pad 200 is a moisture-lock material.

As shown in FIGS. 15 and 16, another embodiment of a changing pad in accordance with the invention is designated generally as 208 includes a substantially planar substrate including an internal compartment 210 in which diaper wipes or other moistened tissues or towelettes can be placed, which compartment 210 is accessible by means of a zipper 212 arranged in a slit formed on an underside of the changing pad 208 (see FIG. 16). Instead of zipper 212 in a slit, other apparatus for accessing the compartment 210 may be provided. The upper surface of the changing pad 208 is provided with an opening communicating with the diaper-wipe receiving compartment 210 and a sheet 214 having a slit 216 is attached to the changing pad 208 to cover the opening. Changing pad 208 includes a flap 218 and an attachment mechanism 220, 222 to enable the flap 218 to be secured to a remaining portion of the changing pad 208, e.g., Velcro® type fasteners, and cause the slit 216 to be covered, when not in use, and thereby prevent moisture from evaporating from the diaper wipes.

Portions of changing pads 200, 208 which define the interior compartment receivable of diaper wipes or serve to close the slit may be made of a moisture-lock material.

Although changing pad 208 is optimally used as a changing pad for changing a diaper on a baby or infant, it could also be used for other purposes. Thus, the changing pad 208 is not limited to its intended use, i.e., the compartment 210 may receive dispensible items other than diaper wipes, such as moistened towelettes or tissues, and can be used for any purpose wherein a clean surface is needed to perform some sort of activity.

While the invention has been described above with respect to specific apparatus and specific implementations, it should be clear that various modifications and alterations can be made, and various features of one embodiment can be included in other embodiments, within the scope of the present invention. For example, the shape of panels 14, 16, 18 of container 10 can vary as desired so long as a compartment can be formed therebetween which can securely retained objects therein, and the position of the attachment mechanism 22, 24 can be varied as desired and in some cases, possibly even eliminated if other means are integrated into one or more of the panels 14, 16 to enable them to be temporarily fastened together. In addition, whenever multiple panels are mentioned, it is envisioned that any two or more panels can be made integral with one another, or that the panels can be made from separate members and attached to one another. Moreover, the size of the container 10 can be selected as desired. In one embodiment, the container 10 is dimensioned to accommodate six average size diapers in the compartment 12, although fewer or more diapers may fit depending on, for example, the size of the diapers and the presence, absence and size of other items in the compartment 48. The same variations apply to the other embodiments of the container described above. Finally, any of the features of any of the embodiments described above can be used in any of the other embodiments described above.

The invention claimed is:

1. A container including an integral, selectively accessible compartment receivable of dispensible items, comprising:

a plurality of panels forming a main interior compartment therebetween, said main compartment having an open state in which said main compartment is accessible and a closed state, a first one of said panels being movable between a closing position in which it closes said main compartment and prevents access thereto and an exposing position in which said main compartment is open and accessible and when in the exposing position, said first panel exposing at least a previously unexposed portion of said first panel or a previously unexposed portion or all of a second one of said panels, said previously unexposed portion of said first panel or said previously unexposed portion or all of said second panel including an opening that is covered only by one of said first panel and said second panel when said first panel is in the closing position and is exposed upon only movement of said first panel apart from said second panel from the closing position to the exposing position, said panels defining a side compartment communicating with said opening; and a cover extending across said opening and including a slit, whereby when dispensible items are retained in said side compartment, each dispensible item is removable from said side compartment through said slit when said first panel is moved from the closing position to the exposing position to expose said previously unexposed portion of said first panel or said previously unexposed portion or all of said second panel including said opening, wherein said first panel is a rear panel having a flap portion and said second panel is a front panel, said flap portion being movable between a position overlying at least a part of said front panel and a position in which said main compartment is open, and said flap portion having a substrate arranged on at least a portion of an inner surface thereof, said substrate comprising a moisture-resistant material, wherein said opening is in said second panel and said substrate is arranged in a position in which it overlies an entirety of said slit and comes into direct surface-to-surface contact with material of said cover directly adjacent said slit on all sides of said slit to completely cover said slit, when said first panel covers said previously unexposed portion or all of said second panel, thereby creating a tight closure over the entirety of said slit and substantially preventing evaporation of moisture from the dispensible items retained in said side compartment.

2. The container of claim 1, wherein said panels further comprise an intermediate panel extending between said front and rear panels on a bottom and sides of said side compartment.

3. The container of claim 1, further comprising an attachment mechanism that attaches said flap portion of said rear panel to said front panel.

4. The container of claim 3, wherein said attachment mechanism comprises one of hook and loop fasteners arranged on said flap portion of said rear panel and the other of hook and loop fasteners arranged on said front panel.

5. The container of claim 1, wherein portions of said panels defining said side compartment are lined with or made from a moisture-lock material which prevents evaporation of moisture from the dispensable items retained in said side compartment.

6. The container of claim 5, wherein said substrate is substantially rectangular and is attached to said inner surface of said flap portion on only three sides, whereby a slot is formed between said substrate and said flap portion of said rear panel into which an identification card is insertable.

7. The container of claim 1, further comprising a first magnetic plate arranged on said second panel around said opening and a second magnetic plate arranged on said first panel opposite said first magnetic plate.

8. The container of claim 1, wherein said panels include a third panel arranged to face an inner surface of said second panel and define said side compartment therebetween.

9. The container of claim 8, further comprising a zipper arranged between upper edge portions of said second and third panels.

10. The container of claim 1, wherein said cover comprises a sheet of plastic attached to said second panel.

11. The container of claim 1, further comprising a strap attached at each end to one of said panels, said strap including a plurality of snaps which enable said strap to assume different configurations.

12. The container of claim 1, further comprising a mesh member attached along its sides and bottom to at least one inward-facing surface of said panels to form an additional side compartment therebetween.

13. The container of claim 1, wherein said panels include a third panel attached to said first panel and defining an additional side compartment, said first panel including a slit, further comprising a zipper arranged in said slit to enable access to said additional side compartment.

14. A container including an integral, selectively accessible compartment receivable of dispensible items, comprising:

a plurality of panels forming a main interior compartment therebetween, said main compartment having an open state in which said main compartment is accessible and a closed state, a first one of said panels being movable between a closing position in which it closes said main compartment and prevents access thereto and an exposing position in which said main compartment is open and accessible and when in the exposing position, said first panel exposing a previously unexposed portion or all of a second one of said panels, said previously unexposed portion or all of said second panel including an opening that is coverable only by said first panel and by no other ones of said panels when said first panel is in the closing position and is thus exposed upon only movement of said first panel apart from said second panel from the closing position to the exposing position, said panels defining a side compartment communicating with said opening; and a cover extending across said opening and including a slit, said slit in said cover being coverable only by said first panel when in the closing position and by no other ones of said plurality of panels, an inner surface of said first panel having a substrate comprising a moisture-resistant material arranged on at least a portion thereof, said inner surface of said first panel being arranged directly opposite an outer surface of said second panel and said cover when said first panel is in the closing position such that said opening is covered only by said first panel and only movement of said first panel from the closing position to the exposing position exposes said slit in said covering extending across said opening, and said substrate being arranged in a position in which it overlies an entirety of said slit and comes into direct surface-to-surface contact with material of said cover directly adjacent said slit on all sides of said slit to completely cover said slit, when said first panel covers said previously unexposed portion or all of said second panel, thereby creating a tight closure over the entirety of said slit and substantially preventing evaporation of moisture from the dispensible items retained in said side compartment, whereby when dispensible items are retained in said side compartment, each dispensible item is removable from said side compartment through said slit when said first panel is moved from the closing position to the exposing position to expose said previously unexposed portion or all of said second panel including said opening.

15. The container of claim 14, further comprising an attachment mechanism that attaches said first panel to said second panel.

16. The container of claim 14, wherein portions of said panels defining said side compartment are lined with or made from a moisture-lock material which prevents evaporation of moisture from the dispensable items retained in said side compartment.

17. The container of claim 16, wherein said substrate is substantially rectangular and is attached to said inner surface of said first panel on only three sides, whereby a slot is formed between said substrate and said first panel into which an identification card is insertable.

18. The container of claim 14, wherein said panels include a third panel arranged to face an inner surface of said second panel and define said side compartment therebetween.

19. The container of claim 14, wherein said cover comprises a sheet of plastic attached to said second panel.

* * * * *